US008376023B2

(12) United States Patent
Furukawa et al.

(10) Patent No.: US 8,376,023 B2
(45) Date of Patent: Feb. 19, 2013

(54) DIE-CASTING DIE AND METHOD FOR DIE-CASTING

(75) Inventors: Yuichi Furukawa, Toyota (JP); Fumio Kawahara, Toyota (JP); Yasushi Iwata, Nishikamo-gun (JP); Hiroaki Iwahori, Aichi-gun (JP); Jun Yaokawa, Nisshin (JP); Atsuto Okamoto, Nishikamo-gun (JP)

(73) Assignees: Toyota Jidosha Kabushiki Kaisha, Toyota-shi (JP); MEC International Co., Ltd., Toyota-shi (JP)

( * ) Notice: Subject to any disclaimer, the term of this patent is extended or adjusted under 35 U.S.C. 154(b) by 0 days.

(21) Appl. No.: 13/127,518

(22) PCT Filed: Oct. 16, 2009

(86) PCT No.: PCT/JP2009/067905

§ 371 (c)(1),
(2), (4) Date: May 4, 2011

(87) PCT Pub. No.: WO2010/064495

PCT Pub. Date: Jun. 10, 2010

(65) Prior Publication Data

US 2011/0209844 A1 Sep. 1, 2011

(30) Foreign Application Priority Data

Dec. 5, 2008 (JP) ..... 2008-311397

(51) Int. Cl.

| | |
|---|---|
| ***B22C 3/00*** | (2006.01) |
| ***B22D 17/22*** | (2006.01) |
| ***B29C 33/56*** | (2006.01) |

(52) U.S. Cl. ..... 164/72; 164/303; 249/115

(58) Field of Classification Search ..... 164/72, 164/138, 14, 33, 267, 303, 472; 249/114.1, 249/115

See application file for complete search history.

(56) References Cited

U.S. PATENT DOCUMENTS

| | | | |
|---|---|---|---|
| 3,933,335 | A | 1/1976 | Maruyama et al. |
| 6,298,898 | B1 | 10/2001 | Mahadeva et al. |

FOREIGN PATENT DOCUMENTS

| | | |
|---|---|---|
| DE | 10032380 | 1/2001 |
| DE | 10128401 | 2/2002 |

(Continued)

OTHER PUBLICATIONS

International Preliminary Report on Patentability issued Jun. 16, 2010, in PCT/JP2009/067905 (English-language translation only).

(Continued)

*Primary Examiner* — Kevin P Kerns

(74) *Attorney, Agent, or Firm* — Oblon, Spivak, McClelland, Maier & Neustadt, L.L.P.

(57) ABSTRACT

A die-casting die is provided. The die-casting die may include a cavity forming surface. A part of the cavity forming surface may be coated with a surface treatment layer. The surface treatment layer may include a mixture of fibrous carbon and particle carbon and have a thermal conductivity that increases in connection to an increase in an acted pressure.

5 Claims, 10 Drawing Sheets

FOREIGN PATENT DOCUMENTS

| | | |
|---|---|---|
| JP | 64 11060 | 1/1989 |
| JP | 64 53756 | 3/1989 |
| JP | 2 37953 | 2/1990 |
| JP | 7 155897 | 6/1995 |
| JP | 8 318362 | 12/1996 |
| JP | 2669488 | 7/1997 |
| JP | 10-156832 | 6/1998 |
| JP | 2001 232443 | 8/2001 |
| JP | 2006 30610 | 2/2006 |
| JP | 2006 327892 | 12/2006 |
| JP | 2007 144499 | 6/2007 |
| JP | 2007 217517 | 8/2007 |
| JP | 2008 105082 | 5/2008 |
| JP | 2010 36194 | 2/2010 |

OTHER PUBLICATIONS

International Search Report Issued Jan. 19, 2010 in PCT/JP09/067905 filed Oct. 16, 2009.

Written Opinion Issued Jun. 16, 2010 in PCT/JP09/67905 filed Oct. 16, 2009 (with partial English translation).

Japanese Office Action issued May 1, 2012, in Japan Patent Application No. 2008-311397 (with English translation).

Office Action issued Jul. 23, 2012 in German Patent Application No. 11 2009 002 705.9 (with English translation).

DIE-CASTING DIE AND METHOD FOR DIE-CASTING

TECHNICAL FIELD

The present application claims priority to Japanese Patent Application No. 2008-311397 filed on Dec. 5, 2008, the contents of which are hereby incorporated by reference into the present specification. The present application provides a technique for a die-casting die and a method for die-casting.

BACKGROUND ART

A die-casting die not only determines the shape of a die-cast product by its cavity forming surface, but also comprises a function of cooling molten material. If the cooling effect on the molten material caused by the die-casting die is too low, a long time is needed until the molten material cools and the shape of the die-cast product is determined. Furthermore, it becomes impossible to obtain an intended crystal configuration (solid structure) in the die-cast product. On the other hand, if the cooling effect on the molten material caused by the die-casting die is too high, the molten material does not flow readily within the cavity, and it becomes difficult to fill the molten material into the cavity. Furthermore, high injection pressure is needed to fill the molten material into the cavity.

In Japanese Patent Application Publication No. 1996-318362 and Japanese Patent Application Publication No. 1995-155897, a technique is taught in which a die-casting die is composed of a plurality of members, and a thermal conductivity of the die-casting die can be changed depending on location by changing the material used to form the members.

SUMMARY OF INVENTION

Technical Problem

In the conventional technique, the thermal conductivity of the die-casting die is changed depending on the location of the cavity forming surface. The conventional technique is devised such that a satisfactory die-cast product can be obtained by unequal spatial distribution of thermal conductivity. However, the conventional technique does not reach the concept of changing the thermal conductivity as a function of time. The present inventors found that advantageous results can be obtained by changing the thermal conductivity as a function of time. The technique taught in the present specification has been realized using this discovery.

For example, in order to properly spread the molten material in the cavity, it is advantageous for the thermal conductivity of the die-casting die to be low so that the molten material is not cooled readily. After the molten material has spread in the cavity, the greater the cooling effect on the molten material caused by the die-casting die, the more the time can be reduced until the shape of the die-cast product is determined, and the time required for the method for die-casting can be reduced thereby. If the phenomenon can be realized where the thermal conductivity of the die-casting die is low until the molten material spreads in the cavity, and the thermal conductivity of the die-casting die is high after the molten material has spread in the cavity, satisfactory die-cast products can be manufactured in a short time. The technique taught in the present specification was developed based on the above discovery.

Solution to Technical Problem

A die-casting die provided by the present application comprises a cavity forming surface. A part of the cavity forming surface is coated with a surface treatment layer having a thermal conductivity that increases in connection to an increase in an acted pressure. In the case of the method for die-casting, the pressure acted on the cavity forming surface is low while the molten material is being spread in the cavity. After the molten material has been spread, the pressure acted on the cavity forming surface increases. To compensate for contraction as the molten material solidifies, the pressure acted on the cavity forming surface increases notably if pressure continues to be applied to the molten material during solidification. If a part of the cavity forming surface is covered by the surface treatment layer which has low thermal conductivity while the pressure acted on the surface treatment layer is low, the molten material is not cooled readily at this portion while the molten material is being spread in the cavity, and consequently the molten material flows smoothly. The molten material can be spread easily in the cavity.

In the surface treatment layer used in the technique taught in the present specification, the thermal conductivity increases as the pressure acted on the surface treatment layer increases. After the molten material has been spread in the cavity, the cooling effect on the molten material by the die-casting die is accelerated by increasing the pressure acted on the surface treatment layer. Since the molten material solidifies rapidly, the processing time for this method for die-casting is reduced. Further, the intended crystal configuration (solid structure) can also be obtained.

It is preferred that the surface treatment layer taught in the present specification is formed partially at a portion near a gate. The portion near the end of the flow path of the molten material has less need of being coated with the surface treatment layer to ensure a smooth flow. It is preferably at the end part that the molten material is quenched by the die-casting die and the surface of the die-cast product is densified.

It is preferred that, in the surface treatment layer taught in the present specification, a surface treatment layer is used in which thermal conductivity increases due to an increase in a bulk density caused in connection with an increase in the acted pressure. For example, when a layer including a mixture of fibrous carbon and particle carbon is used in the surface treatment layer, the thermal conductivity increases due to the increase in the bulk density caused in connection with the increase in the acted pressure.

In particular, it is preferred that the thermal conductivity of an area of the cavity forming surface coated with the surface treatment layer is equal to or less than 2 W/mK under a nonpressurized state, and a thermal conductivity of an area of the cavity forming surface not coated with the surface treatment layer is equal to or more than 30 W/mK. In this case, because efficiency of cooling the molten material by the die-casting die is increased in the area not coated with the surface treatment layer, a chill layer (a dense surface layer having a crystal configuration or solid structure) that forms the surface of the die-cast product is formed thickly. On the other hand, if the thermal conductivity of the die material is equal to or more than 30 W/mK, the cooling effect on the molten material is so prominent that it is difficult to spread the molten material into the cavity. In the case where a part of the cavity forming surface is covered with a material having the thermal conductivity equal to or less than 2 W/mK under the nonpressurized state, the cooling of the molten material is inhibited, and satisfactory spreading can be ensured.

The technique taught in the present specification can also be realized in a method for die-casting. This method for die-casting comprises: coating a part of a cavity forming surface with a surface treatment layer having a thermal conductivity that increases due to an increase in a bulk density caused in connection to an increase in a pressure acted on the part of the cavity forming surface; inhibiting cooling of a molten material by a die-casting die by keeping the bulk density and the thermal conductivity of the surface treatment layer at low values until filling of the molten material to a cavity is completed; and accelerating the cooling of the molten material by the die-casting die by increasing the bulk density and the thermal conductivity of the surface treatment layer after the filling of the molten material to the cavity is completed. According to this method for die-casting, the molten material is easily filled into the cavity, and the molten material filled into the cavity solidifies rapidly. According to this method for die-casting, high quality die-cast products can be manufactured in a short time.

In particular, it is preferred that, for inhibiting the cooling of the molten material by the die-casting die so as to accelerate a flow of the molten material, the thermal conductivity of an area of the cavity forming surface is set to be equal to or less than 2 W/mK under a nonpressurized state by coating the area of the cavity forming surface with the surface treatment layer; and, for accelerating the cooling of the molten material by the die-casting die, a thermal conductivity of an area of the cavity forming surface is set to be equal to or more than 30 W/mK by not coating the range of the cavity forming surface with the surface treatment layer. In this case, both effects of rapidly cooling the molten material by the die-casting die and ensuring the liquidity of the molten material by inhibiting the cooling of the molten material by using material having low thermal conductivity can be achieved.

Effect of Invention

According to the die-casting die or method for die-casting taught in the present specification, the cooling effect on the molten material by the die-casting die can be changed as the die-casting process proceeds, allowing superior quality die-cast products to be manufactured in a short time.

DESCRIPTION OF EMBODIMENTS

Some primary features of the embodiment described below are listed first.

(Feature 1) Die material having a thermal conductivity equal to or more than 30 W/mK is used as the die material of a die-casting die.

(Feature 2) Die material having a thermal conductivity equal to or more than 200 W/mK is used in the die material of the die-casting die.

(Feature 3) A part of a cavity forming surface is covered by a material having a thermal conductivity equal to or less than 2 W/mK under a nonpressurized state.

Figure 1:
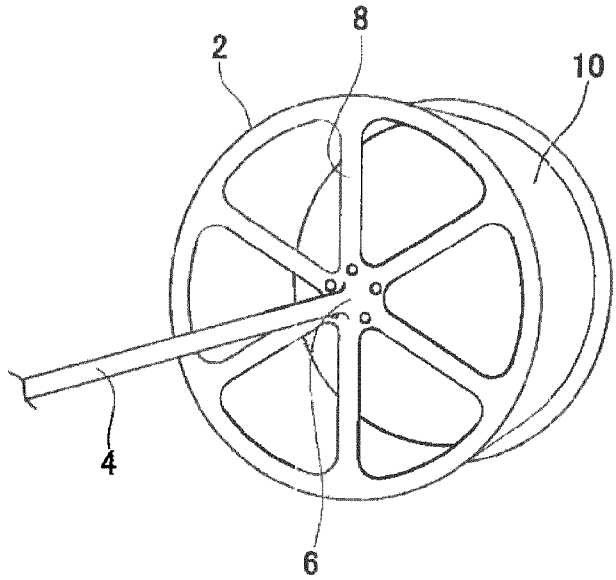
FIG. 1 is an aluminum wheel used for a vehicle cast by a die-casting die.

FIG. 1 shows an aluminum wheel 2 used for a vehicle cast using a die-casting die and a method for die-casting of the embodiment. The wheel 2 is composed of a disk 6, spokes 8, and a rim 10. The reference number 4 shows a portion where molten material has solidified within a molten material injection gate.

Figure 2:
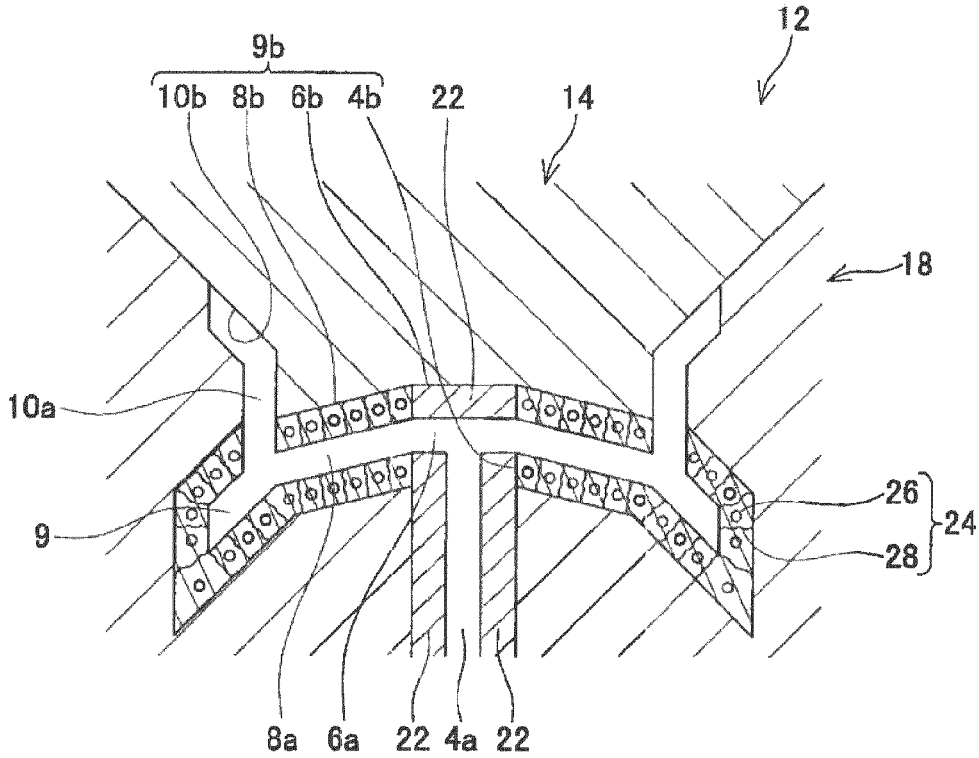
FIG. 2 is a cross-sectional view of the die-casting die of the embodiment.

FIG. 2 shows a cross-sectional view of a die-casting die 12 of the embodiment. The die-casting die 12 is composed of an upper die 14 and a lower die 18. A thermal conductivity of the upper die 14 is 200 W/mK. The thermal conductivity of the lower die 18 is also 200 W/mK. A space formed when the upper die 14 and the lower die 18 are clamped together is a cavity 9. The cavity 9 is composed of a disk forming part 6*a*, spoke forming parts 8*a*, and a rim forming part 10*a*. The reference number 22 is insulating material. Cavity forming surfaces 6*b* that form wall surfaces of a gate 4*a* and the disk forming part 6*a* are coated with the insulating material 22. The reference number 24 is a mixture of particle carbon 26 and fibrous carbon 28. Cavity forming surfaces 8*b* that form the spoke forming parts 8*a* are coated with the mixture 24 made from the particle carbon 26 and the fibrous carbon 28. The particle carbon 26 is carbon fullerenes. The fibrous carbon 28 is carbon nanotubes, carbon fiber, etc. In the present embodiment, fullerenes are used in the particle carbon 26, and carbon nanotubes are used in the fibrous carbon 28. The mixture 24 of fullerenes and carbon nanotubes is denoted as "CnF 24". The technique taught in Japanese Patent Application Publication No. 2008-105082 can be used to form a layer of the fibrous carbon 28 on the surface of the die-casting die.

In a state when pressure is not being acted, an interior of the CnF 24 contains voids, and a bulk density and a thermal conductivity of the CnF 24 are low. In the state when pressure is not being acted, the CnF 24 has the thermal conductivity equal to or less than 2 W/mK, and functions essentially as an insulation layer. When pressure is acted on the CnF 24, the fibrous carbon 28 deforms elastically, and the voids decrease. When pressure is acted on the CnF 24, the bulk density and the thermal conductivity of the CnF 24 increases. When pressure is acted, the CnF 24 changes into a thermally conductive layer.

Since the cavity forming surfaces 4*b*, 6*b* respectively corresponding to the areas of the gate 4*a* and the disk forming part 6*a* are coated with the insulating material 22, a flow of molten material in those areas is extremely smooth. Further, the cavity forming surfaces 8*b* corresponding to the areas of the spoke forming parts 8*a* are coated with the CnF 24. The pressure acted on the CnF 24 is low until filling the molten material into the cavity 9 is completed, and consequently the thermal conductivity of the CnF 24 is low. The molten material is not cooled while flowing into the spoke forming parts 8*a*. Consequently, the molten material flows smoothly through the spoke forming parts 8*a*. The molten material spreads rapidly into the cavity 9.

The cavity forming surface 10*b* corresponding to the area of the rim forming part 10*a* is not covered by a surface treatment layer, and has the high thermal conductivity of 200 W/mK. Since the thermal conductivity of the cavity forming surface 10*b* corresponding to the area of the rim forming part 10*a* is high, the molten material that has reached the rim forming part 10*a* is quenched by the die-casting die 12. Since the molten material is quenched, a thick chill layer is formed at the rim 10 of the wheel 2. The solid structure of the chill layer has a dense and hard surface configuration. After the molten material has spread into the cavity 9, the pressure acted on a cavity forming surface 9*b* increases. By increasing the pressure acted on the cavity forming surface 9*b*, the bulk density of the CnF 24 increases, and the thermal conductivity of the CnF 24 increases. Consequently, the thermal conductivity of the cavity forming surfaces 8*b* corresponding to the spoke forming parts 8*a* increases. By increasing the thermal conductivity, the molten material is cooled in the spoke forming parts 8*a*. The cooling efficiency of the spoke forming parts 8*a* is lower than the cooling efficiency of the rim forming part 10*a*, but is higher than the cooling efficiency of a case in which it is coated with CnF 24, which retains the low bulk density. The molten material solidifies at an intermediate rate in the spoke forming parts 8*a*. The crystals (solid structure) grown within the spokes 8 do not become coarse, and a strong crystal configuration is formed within the spokes 8.

In the spoke forming parts 8*a*, the thermal conductivity of the cavity forming surfaces 8*b* changes as the die-casting process proceeds. Fluidity is extremely good in the gate 4*a*, the disk forming part 6*a*, and the spoke forming parts 8*a* until the molten material has spread into the cavity 9. The molten material spreads smoothly into the rim forming part 10*a*. The cavity 9 can be filled with the molten material in a short time. After the molten material has spread into the cavity 9, the thermal conductivity in the spoke forming parts 8*a* increases, and cooling of the molten material begins. Oriented solidification can thus be realized. By covering a part of the cavity forming surface 9*b* with a film of the CnF 24, the flow and the solidification process of the molten material can be adjusted spatially. By using the film of CnF 24 which has its thermal conductivity changed by pressure, the flow and the solidification process of the molten material can be adjusted as a function of time. By adjusting the thermal conductivity in terms of space and time, an oriented solidification phenomenon can also be obtained. Desired die-cast products can be cast in a short time.

When the cavity forming surfaces 8*b* are covered by the film of CnF 24, not only is the thermal conductivity changed as the die-casting process proceeds, but the molten material can also be prevented from burning onto the cavity forming surfaces 8*b*, or chemicals can be prevented from penetrating the cavity forming surfaces 8*b*, etc.

Figure 3:
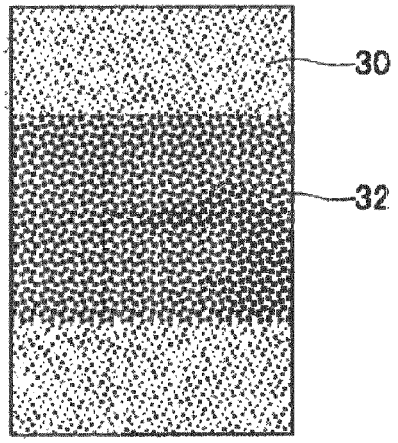
FIG. 3 is a schematic view showing a size of crystal grains of a die-cast product cast when die material having a thermal conductivity of 200 W/mK is used.

FIG. 3 is a schematic view showing a size of crystal grains of the die-cast product cast at a portion where the surface of the die material having the thermal conductivity of 200 W/mK is not covered by the surface treatment layer. The reference number 30 shows the chill layer. This chill layer 30 is formed from dense crystal grains formed by quenching by the die-casting die 12. Since the molten material is quenched by the die material having the high thermal conductivity, the chill layer 30 is thick. The reference number 32 is composed of fine crystal grains. These fine crystal grains are formed by being hardened in a state where the cooling speed is fast. By using die material having an extremely high thermal conductivity, the crystal grains within the die-cast product also become fine. The rim 10 of the die-cast product of the embodiment has a crystal configuration identical to that in FIG. 3.

Figure 4:
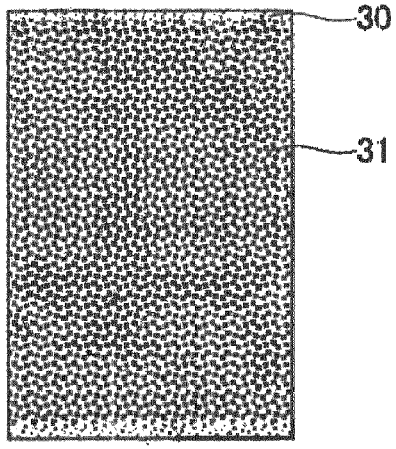
FIG. 4 is a schematic view showing the size of crystal grains of the die-cast product cast when die material having the thermal conductivity of 2 W/mK is used under a nonpressurized state.

FIG. 4 is a schematic view showing the size of crystal grains of the die-cast product cast at a portion where a material having the thermal conductivity of 2 W/mK under the nonpressurized state, i.e., the surface treatment layer of CnF 24, was formed. The reference number 30 is the chill layer formed from the dense crystal grains. Since the surface of the die material is coated with the CnF 24, the die material is insulated until the molten material has spread in the cavity 9. The molten material does not solidify during the filling, and liquidity of the molten material is not reduced. After the cavity 9 has been filled, the pressure acted on the cavity forming surface 9*b* increases, thereby increasing the thermal conductivity of the CnF 24. Consequently, the rate of capturing heat from the molten material through the wall surface increases, and since the molten material is cooled rapidly even into its interior, a layer 31 of the fine crystal grains is formed thickly. The thick layer 31 of the fine crystal grains displays strong interior strength. The spokes 8 of the die-cast product of the embodiment have a crystal configuration identical to that in FIG. 4.

Figure 5:
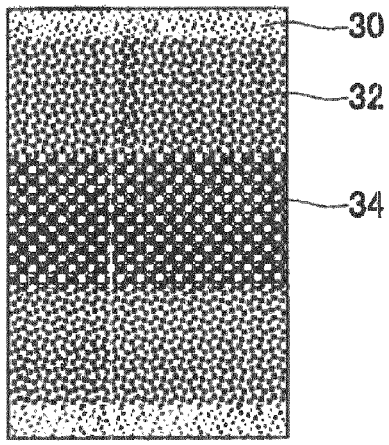
FIG. 5 is a schematic view showing the size of crystal grains of the die-cast product cast when conventional die material is used.

FIG. 5 is a schematic view showing the size of crystal grains of a die-cast product cast using a conventional die-casting die (upon which the surface treatment layer is not formed). Since the reference numbers 30 and 32 have a configuration identical to that of FIG. 3, a description thereof is omitted. The reference number 34 shows a layer consisting of coarse crystal grains. Tensile strength is a problem for the layer 34 composed of coarse crystal grains. The die-cast product of FIG. 5 which has the coarse crystal grains in its interior cannot be said to have sufficient internal strength.

In the conventional die-cast product, the coarse crystal grain layer 34 is formed in its interior. This tends to lack strength. Further, the thick chill layer 30 is also formed to some extent. As shown in FIG. 5, the liquidity of the molten material decreases since solidification occurs while the molten material is being filled. When the surface of the die material is coated with the CnF 24, as illustrated in FIG. 4, there is no coarse crystal grain layer in the interior, and internal strength is increased. By making the chill layer 30 thinner, the fluidity improves.

If the CnF 24 is applied to the surface of the die material at a location requiring satisfactory fluidity, the satisfactory fluidity can be ensured, and the strength of the die-cast product can also be ensured. Further, by using the die material having the large thermal conductivity, a die-cast product can be obtained whose surface has a dense crystal configuration. In this type of die-cast product, the crystal grain (solid structure) is small even in the interior, and thereby the internal strength increases.

By using the CnF 24, a die material that quenches the molten material can be selected without being restricted to conditions ensuring the fluidity. A die material having the thermal conductivity equal to or more than 30 W/mK can be selected without concerns about ensuring the fluidity. If the CnF 24 is used, the thermal conductivity can be reduced to equal to or less than 2 W/mK, and the satisfactory fluidity can be ensured even in the case of using the die material having the thermal conductivity of equal to or more than 30 W/mK. If a portion having the extremely high thermal conductivity (equal to or more than 30 W/mK) and a portion having the extremely low thermal conductivity (equal to or less than 2 W/mK) are used depending on locations in the die, the thick chill layer and the strong inner layer can be formed separately. In particular, when a die material having thermal conductivity equal to or more than 200 W/mK and a surface treatment layer having thermal conductivity equal to or less than 2 W/mK are used in combination, the direction in which the molten material solidifies can be stably controlled, and a stable oriented solidification phenomenon can be obtained. The crystal configuration within the die-cast product is easily controlled.

Figure 6:
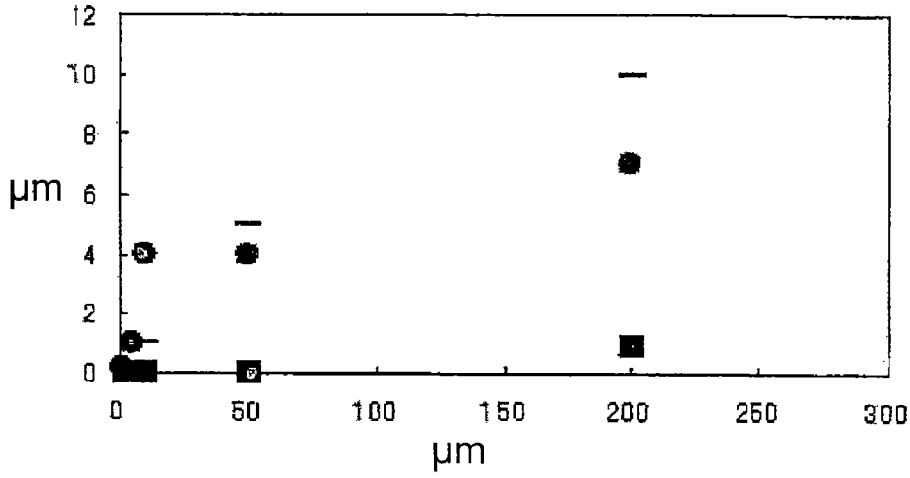
FIG. 6 shows a relationship between a distance from a die-cast surface and the crystal grain size.

FIG. 6 shows the relationship between a depth from a surface of the die-cast product and the crystal grain size. A horizontal axis of a graph of FIG. 6 shows the depth from the surface of the die-cast product. A vertical axis of the graph shows the crystal grain size. Squares represent measurements of the die-cast product formed in an area bordering the die material having the thermal conductivity equal to or more than 200 W/mK (where the surface treatment layer is not formed). Circles represent measurements of the die-cast product formed in an area bordering the die material having the surface treatment layer having the thermal conductivity equal to or less than 2 W/mK. Horizontal line marks represent measurements of the die-cast product formed in an area bordering the die material having the thermal conductivity of 23 W/mK (the conventional die-casting die).

Figure 7:
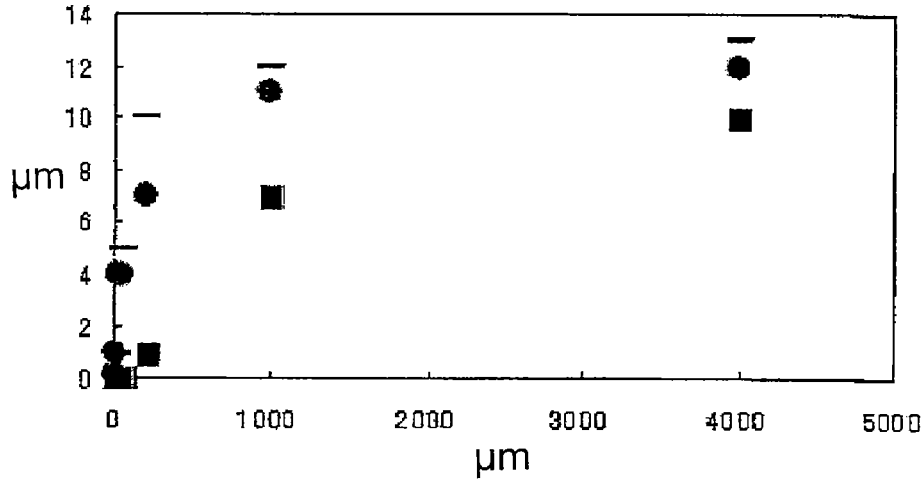
FIG. 7 shows the relationship between distance from the die-cast surface and crystal grain size.

FIG. 7 represents measurements of an area at a greater depth than FIG. 6. As is clearly understood from FIGS. 6 and 7, the thick chill layer is formed (as is understood from FIG. 6, a chill layer at least equal to or more than 200 μm) by using the die material having the thermal conductivity equal to or more than 200 W/mK. Further, it can be seen that the chill layer can be kept thin by using the surface treatment layer having the thermal conductivity equal to or less than 2 W/mK. It can be seen from FIG. 6 that the thickness of the chill layer is 10 μm when the surface treatment layer having the thermal conductivity equal to or less than 2 W/mK is used. Since the thermal conductivity increases after the molten material has been filled into the cavity 9 even though the surface treatment layer having the thermal conductivity equal to or less than 2 W/mK is used, the molten material solidifies rapidly in the portion bordering the surface treatment layer as well, and the die-casting method is completed within a short time.

Figure 8:
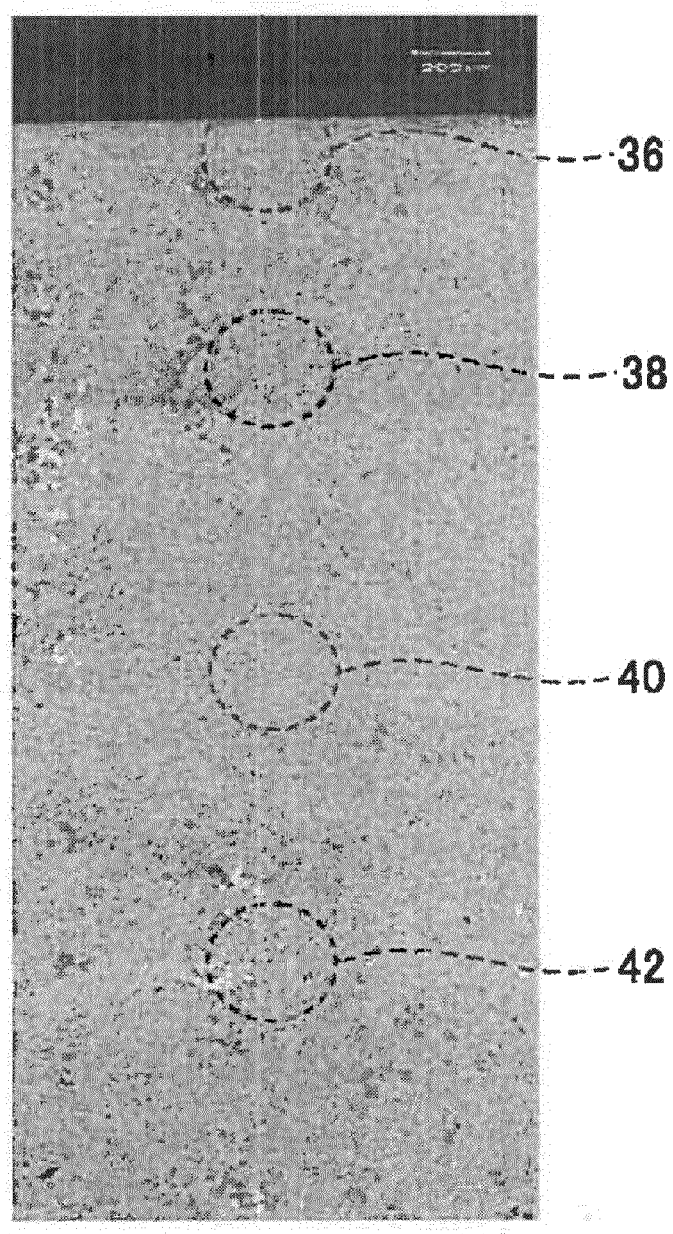
FIG. 8 shows a microphotograph of a cross-section of a die-cast product cast when die material having a thermal conductivity of 2 W/mK was used under a nonpressurized state.
Figure 9:
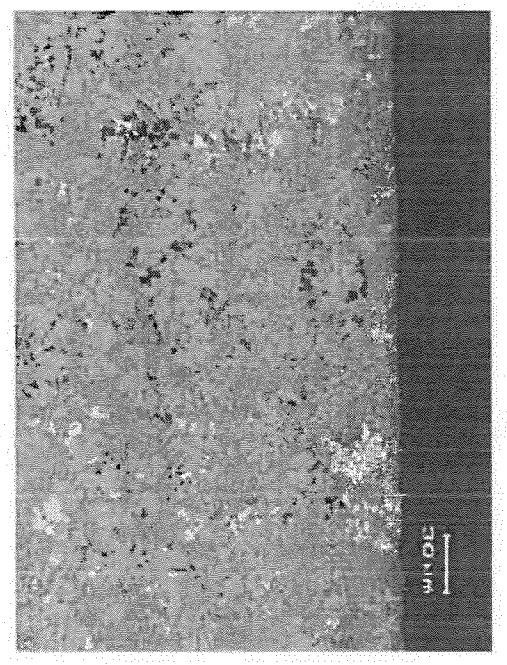
FIG. 9 shows a microphotograph of an area 36.
Figure 10:
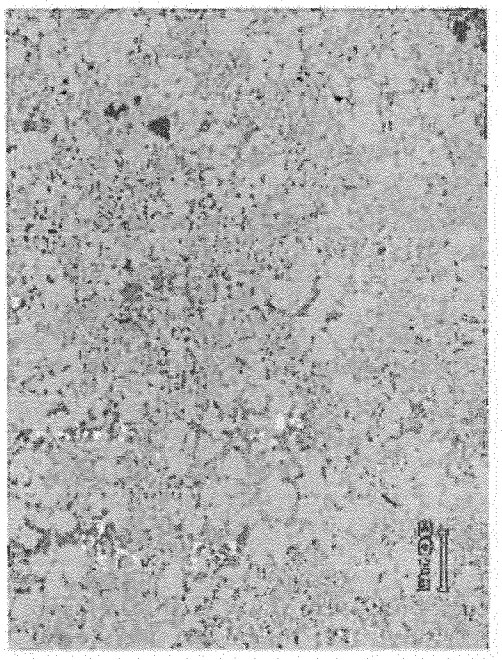
FIG. 10 shows a microphotograph of an area 38.
Figure 11:
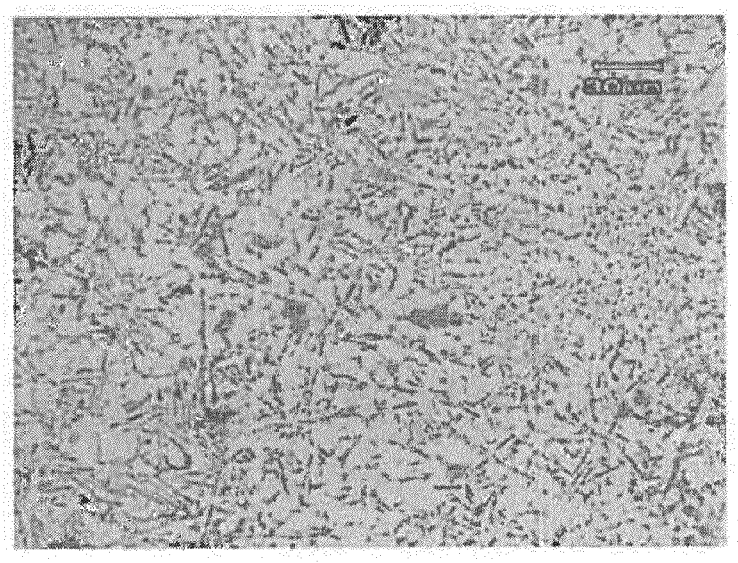
FIG. 11 shows a microphotograph of an area 40.
Figure 12:
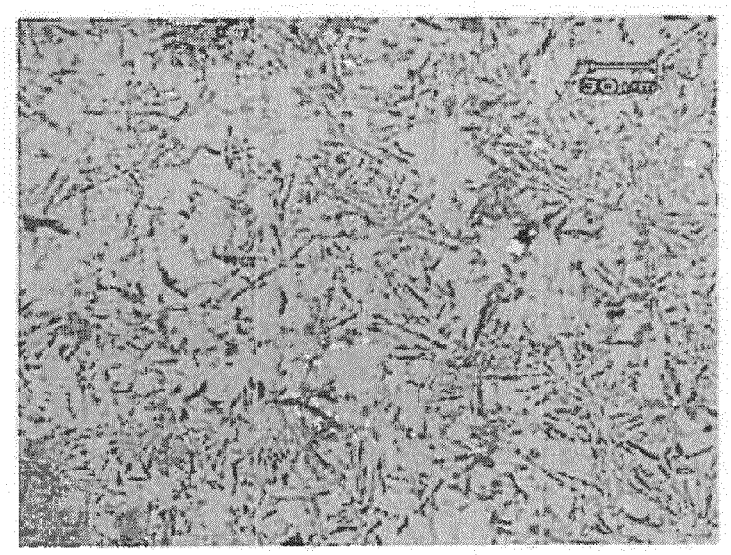
FIG. 12 shows a microphotograph of an area 42.
Figure 13:
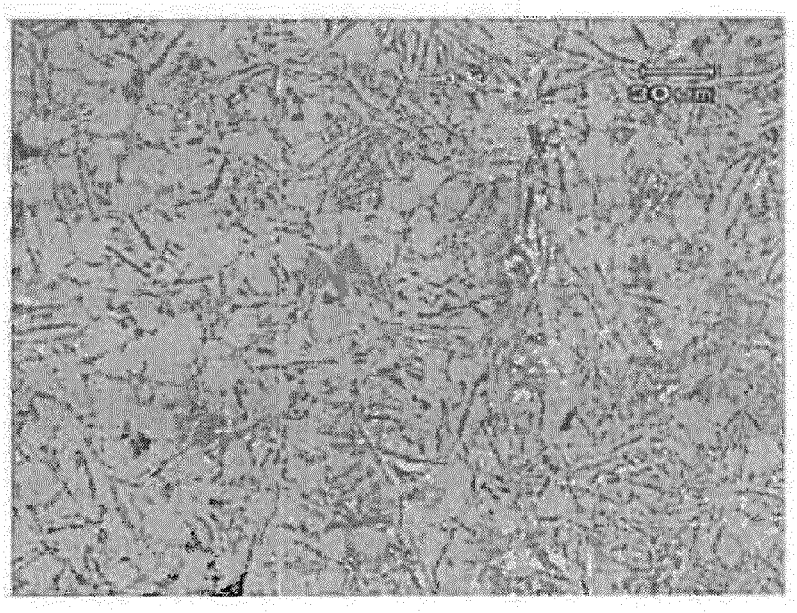
FIG. 13 shows a microphotograph of the die-cast product near the center in its direction of thickness.

FIG. 8 is a cross-sectional microphotograph of a die-cast product having the thickness of 8 mm cast using the die-casting die 12 coated with the CnF 24. An area up to 3 mm from the surface is shown. FIG. 9 is an enlarged photograph of an area 36 of FIG. 8, and shows the solid structure near the surface of the die-cast product. As shown in FIG. 9, the crystal grain size is approximately constant. FIG. 10 is an enlarged photograph of an area 38 of FIG. 8. FIG. 11 is an enlarged photograph of an area 40. FIG. 12 is an enlarged photograph of an area 42. FIG. 13 is an enlarged photograph of a periphery of a central part of the die-cast product of FIG. 8 in its direction of thickness. That is, FIG. 10 is an enlarged photograph of the periphery of a position at a distance approximately 700 μm from the surface. FIG. 11 is an enlarged photograph of the periphery of a position at the distance approximately 1400 μm from the surface. FIG. 12 is an enlarged photograph of the periphery of a position at the distance approximately 2000 μm from the surface. FIG. 13 is an enlarged photograph of the periphery of a position at the distance approximately 4000 μm from the surface.

The solid structure changes, as shown in FIGS. 9, 10, 11, 12, and 13, from the surface to the interior of the die-cast product. The crystal grain size of the die-cast product in FIG. 10 is somewhat smaller than the grain sizes shown from FIG. 11 to FIG. 13. In FIGS. 11, 12, and 13, the size of the crystal grains constituting the die-cast product is approximately uniform. Since the cavity forming surfaces 8*b* are coated with the CnF 24, the cooling speed near the surface is slower than in the case of not being coated. On the other hand, the cooling speed of the interior is rapid due to the die-casting die 12 having the thermally conductive properties, and consequently the solid structure of the interior of the die-cast product does not become coarse. Consequently, a strong solid structure is formed in the interior of the die-cast product at the area of the cavity forming surface 8*b* coated with the CnF 24.

Figure 14:
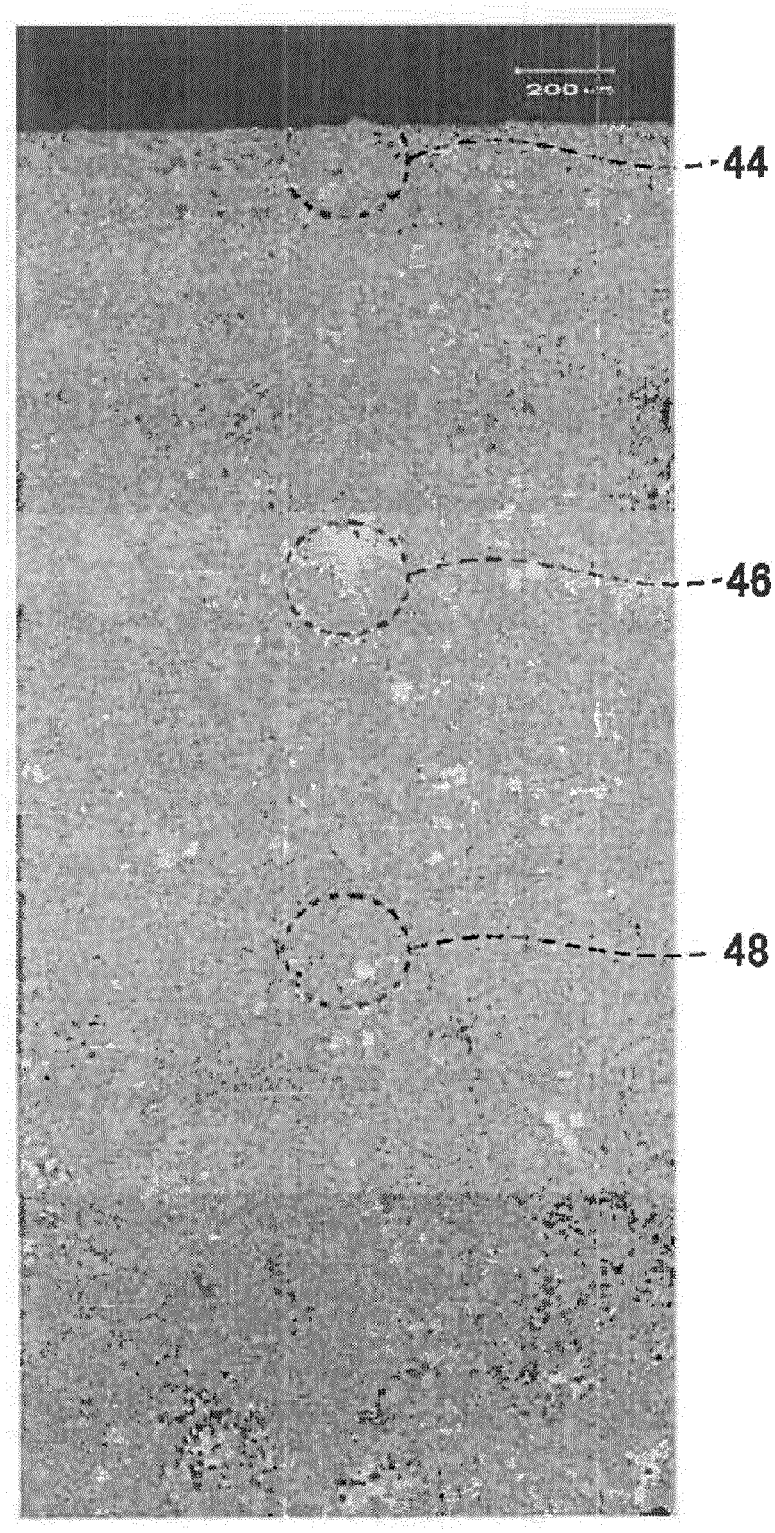
FIG. 14 shows a microphotograph of a cross-section of a conventional die-cast product.
Figure 15:
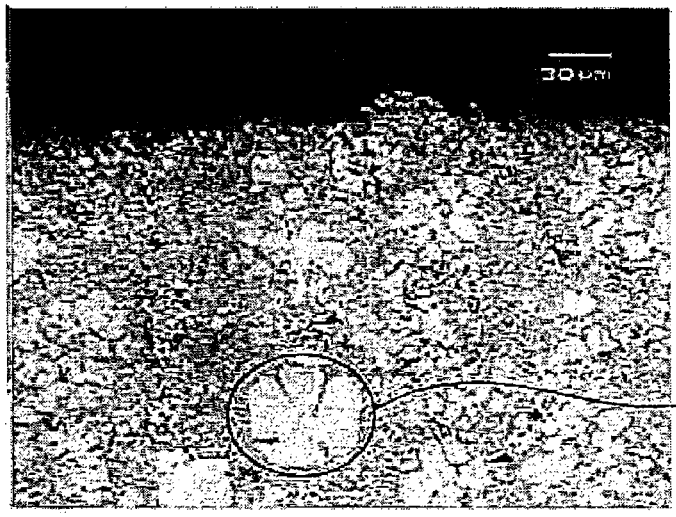
FIG. 15 shows a microphotograph of an area 44.
Figure 16:
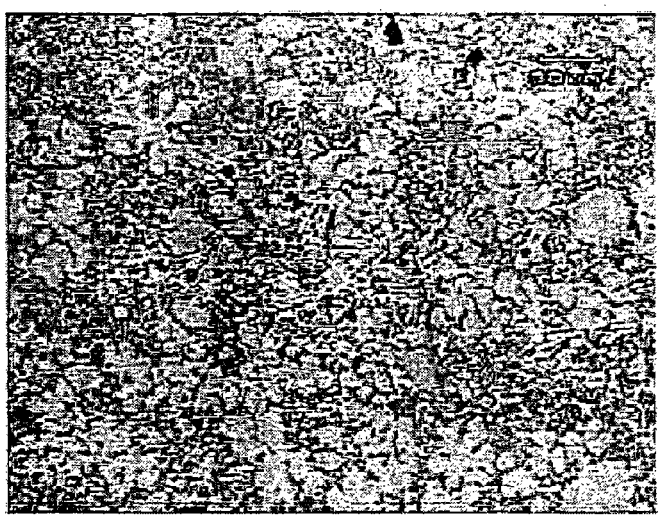
FIG. 16 shows a microphotograph of an area 46.
Figure 17:
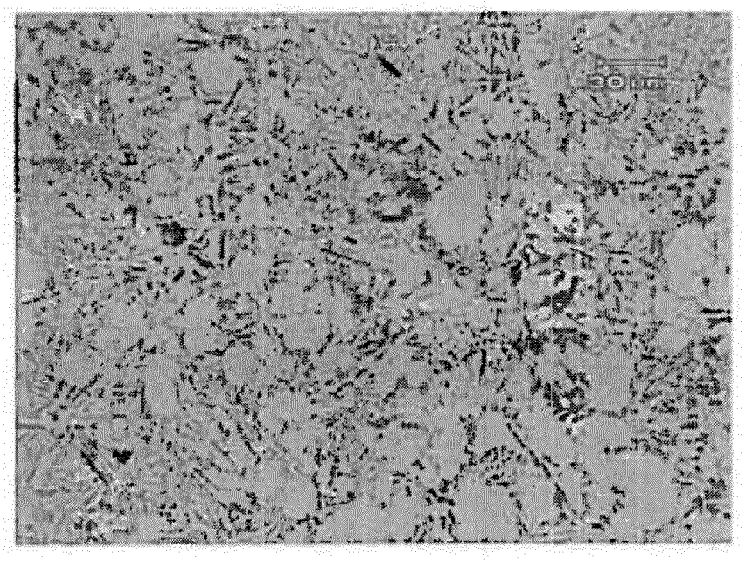
FIG. 17 shows a microphotograph of an area 48.
Figure 18:
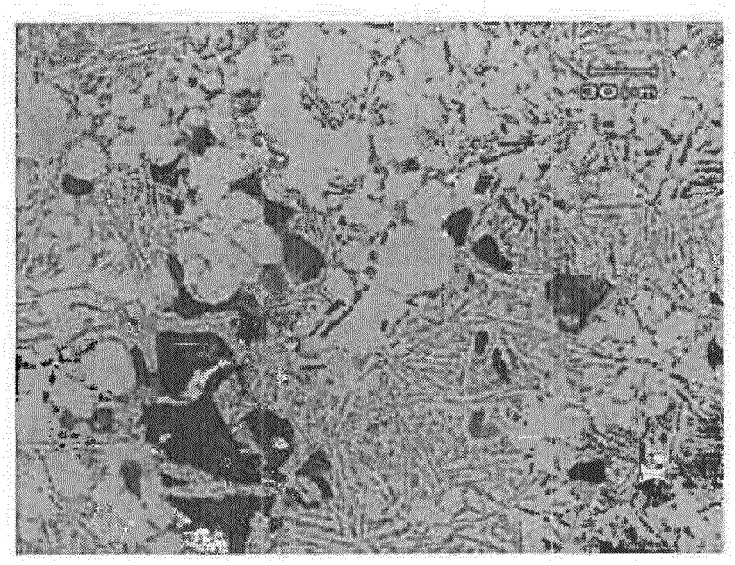
FIG. 18 shows a microphotograph of a conventional die-cast product near the center in its direction of thickness.

FIG. 14 is a cross-sectional microphotograph of the die-cast product having the thickness of 8 mm cast using the conventional die-casting die. An area up to 3 mm from the surface is shown. FIG. 15 is an enlarged photograph of an area 44 of FIG. 14. FIG. 16 is an enlarged photograph of an area 46. FIG. 17 is an enlarged photograph of an area 48. FIG. 18 is an enlarged photograph of a periphery of a central part of the die-cast product of FIG. 14 in its direction of thickness. That is, FIG. 15 is an enlarged photograph of the solid structure near the surface of the die-cast product. FIG. 16 is an enlarged photograph of the periphery of a position at a distance approximately 900 μm from the surface. FIG. 17 is an enlarged photograph of the periphery of a position at the distance approximately 1700 μm from the surface. FIG. 18 is an enlarged photograph of the periphery of a position at the distance approximately 4000 μm from the surface.

The solid structure changes, as shown in FIGS. 15, 16, 17, and 18, from the surface toward the interior of the die-cast product. In FIG. 15, the reference number 50 shows coarse primary crystals. The coarse primary crystals 50 are formed due to poor fluidity at the cavity forming surface. As shown in FIGS. 16 and 17, the size of the crystal grains constituting the die-cast product is approximately uniform. However, coarse crystals are present in FIG. 18. Since coarse crystals are present at the central part of this die-cast product in its direction of thickness and the size of the crystal grains is not uniform, sufficient strength cannot be obtained. When a cross-section of the die-cast product cast using the die-casting die having thermal conductivity equal to or more than 30 W/mK is observed, the crystal configuration shown in FIG. 3 is observed.

If the layer of CnF 24 is formed on the surface of the die-casting die 12, insulation between the molten material and the surface of the die-casting die 12 is possible until the pressure on the layer of CnF 24 increases. Since the molten material is insulated from the die-casting die 12, the temperature of the molten material is maintained, and the flow of the molten material is extremely good. Consequently, the coarse primary crystals 50 are not formed. Since the molten material is insulated from the die-casting die 12, even if primary crystals crystallize during the filling process they do not grow large, and a coarse solid structure is not formed. By not developing coarse crystal grains, a strong solid structure can be obtained in the interior of the die-cast product.

When the layer of CnF 24 is formed at a part of the cavity forming surface 9*b* of the die-casting die 12, solidification of the molten material is inhibited while the molten material is flowing in the cavity 9. By forming the layer of CnF 24 such that part of the cavity forming surface 9*b* can avoid quenching, elaborate die-cast products can be cast.

By covering the die-casting die 12 with the layer of CnF 24, quenching by the die-casting die 12 can be avoided until filling of the molten material has ended. Conversely, a heat shock imposed on the die-casting die 12 can also be alleviated. Since the CnF 24 keeps thermal conductivity low (equal to or less than 2 W/mK), the selection of die material is widened in scope. A material having a high thermal conductivity can be selected as the die material without taking the liquidity of the molten material into consideration. After filling of the molten material into the cavity 9 ends, the cooling within the cavity 9 is accelerated. When a material having a high thermal conductivity (equal to or more than 30 W/mK) is used in the die material, a thick chill layer can be formed.

By coating a part of the cavity forming surface 9*b* with the surface treatment layer of CnF 24, the thermal conductivity is locally controlled in terms of space. Since the thermal conductivity of the CnF 24 increases as the pressure acted on the CnF 24 increases, the thermal conductivity is also controlled in terms of the function of time. An oriented solidification phenomenon can be realized by controlling the thermal conductivity not just in terms of space, but also in terms of the function of time.

The technical elements explained in the present specification and drawings provide technical utility either independently or through various combinations and not limited to the combinations described at the time the claims are filed. Further, the purpose of the examples illustrated by the present specification or drawings is to satisfy multiple objectives simultaneously, and satisfying any one of those objectives gives technical utility.

The invention claimed is:

1. A die-casting die, comprising:

a cavity forming surface configured to contain a molten material within the cavity, wherein a part of the cavity forming surface is coated with a surface treatment layer and a part of the cavity forming surface is not coated with the surface treatment layer, wherein the surface treatment layer includes a mixture of fibrous carbon and particle carbon and has a thermal conductivity that increases in connection to an increase in pressure applied to the cavity forming surface by the molten material.

2. The die-casting die according to claim 1, wherein the part of the cavity forming surface is coated with the surface treatment layer having the thermal conductivity that increases due to an increase in a bulk density caused in connection to the increase in the acted pressure.

3. The die-casting die according to claim 1, wherein the thermal conductivity of an area of the cavity forming surface coated with the surface treatment layer is equal to or less than 2 W/mK under a nonpressurized state, and a thermal conductivity of an area of the cavity forming surface not coated with the surface treatment layer is equal to or more than 30 W/mK.

4. A method for die-casting, comprising:

coating only a part of a cavity forming surface of a cavity with a surface treatment layer, the surface treatment layer including a mixture of fibrous carbon and particle carbon and having a thermal conductivity that increases due to an increase in a bulk density caused in connection to an increase in pressure applied to the cavity forming surface;

inhibiting cooling of a molten material by a die-casting die by keeping the bulk density and the thermal conductivity of the surface treatment layer at lower values until a filling of the molten material to the cavity is completed; and accelerating the cooling of the molten material by the die-casting die by increasing the bulk density and the thermal conductivity of the surface treatment layer after the filling of the molten material to the cavity is completed.

5. The method for die-casting according to claim 4, further comprising:

setting a thermal conductivity of an area of the cavity forming surface, for inhibiting the cooling of the molten material by the die-casting die so as to accelerate a flow of the molten material, to be equal to or less than 2 W/mK under a nonpressurized state by coating the area of the cavity forming surface with the surface treatment layer; and setting a thermal conductivity of an area of the cavity forming surface, for accelerating cooling of the molten material by the die-casting die, to be equal to or more than 30 W/mK by not coating the range of the cavity forming surface with the surface treatment layer.

* * * * *